US008427129B2

(12) United States Patent
Howe

(10) Patent No.: US 8,427,129 B2
(45) Date of Patent: Apr. 23, 2013

(54) HIGH CURRENT DRIVE BANDGAP BASED VOLTAGE REGULATOR

(76) Inventor: Scott Lawrence Howe, Campbellville (CA)

( * ) Notice: Subject to any disclaimer, the term of this patent is extended or adjusted under 35 U.S.C. 154(b) by 407 days.

(21) Appl. No.: 12/138,914

(22) Filed: Jun. 13, 2008

(65) Prior Publication Data

US 2008/0309308 A1 Dec. 18, 2008

Related U.S. Application Data

(60) Provisional application No. 60/944,211, filed on Jun. 15, 2007.

(51) Int. Cl.
*G05F 1/577* (2006.01)
*G05F 1/56* (2006.01)

(52) U.S. Cl.
USPC ..... 323/313; 323/273; 323/316

(58) Field of Classification Search ..... 323/265, 323/273, 274, 275, 280, 281, 349, 313, 316
See application file for complete search history.

(56) References Cited

U.S. PATENT DOCUMENTS 4,438,388 A 3/1984 Lee
4,645,948 A * 2/1987 Morris et al. ..... 327/538
4,714,872 A 12/1987 Traa
5,300,877 A 4/1994 Tesch
5,339,272 A 8/1994 Tedrow et al.
5,686,823 A 11/1997 Rapp
6,075,407 A * 6/2000 Doyle ..... 327/539
6,198,266 B1 * 3/2001 Mercer ..... 323/316
6,201,379 B1 * 3/2001 MacQuigg et al. ..... 323/313
6,407,622 B1 6/2002 Opris
6,563,371 B2 5/2003 Buckley, III et al.
6,703,816 B2 * 3/2004 Biagi et al. ..... 323/280
6,856,124 B2 * 2/2005 Dearn et al. ..... 323/280
7,233,136 B2 * 6/2007 Makino et al. ..... 323/313
7,492,137 B2 * 2/2009 Yamada ..... 323/280
7,679,352 B2 * 3/2010 Peng et al. ..... 323/313
7,688,054 B2 * 3/2010 Cave ..... 323/313
2002/0130707 A1 9/2002 Somerville et al.
2003/0038672 A1 2/2003 Buckley, III et al.

* cited by examiner

*Primary Examiner* — Gary L Laxton
(74) *Attorney, Agent, or Firm* — Trellis IP Law Group, PC

(57) ABSTRACT

A high current drive bandgap based voltage regulator for providing a reference voltage at a an output voltage at a designed output voltage value. The high current drive bandgap based voltage regulator includes a high current drive output transistor, a feedback network, an output terminal and an operational amplifier. The feedback network is coupled between the output of the transistor and the input of the transistor. The operational amplifier is in the feedback network and has at least two operational amplifier input terminals and an operational amplifier output terminal. The operational amplifier output terminal is coupled to the transistor input terminal, and the operational input terminals are coupled to the transistor output terminal. The output terminal of the high current drive bandgap based voltage regulator is coupled to the output of the high current drive transistor. The high current drive bandgap based voltage regulator is operable to provide a current of at least 100 μA to the output terminal while maintaining the output voltage at the output terminal at a value substantially equal to the designed output voltage value.

16 Claims, 6 Drawing Sheets

HIGH CURRENT DRIVE BANDGAP BASED VOLTAGE REGULATOR

FIELD OF THE INVENTION

This invention relates to voltage reference generation circuits.

BACKGROUND OF THE INVENTION

Electronic devices and systems are pervasive in modern society. The key components of many modern electronic systems and devices include semiconductor chips. The semiconductor chips may be used for a variety of purposes and include such things as control circuitry and memory devices.

Many of the semiconductor chips that are used for various applications consist of a semiconductor die that is housed in a package. The semiconductor die contained in a package is electrically connected to the input and output leads of the package. The package is in turn electrically coupled to various other circuitry in the electronic device. Among the inputs that are supplied to the chip from the other circuitry to which it is coupled is a power supply input.

The power that is supplied to the chip by the other circuitry is often not adequate for the chip's requirements. This may be the case for a variety of reasons. For example, the power supply may have too much noise for the chip to function at its optimum level.

The high current drive bandgap based voltage regulator includes a high current drive output transistor having a transistor input terminal and a transistor output terminal. A feedback network is coupled between the output of the transistor and the input terminal of the transistor. The high current drive bandgap based voltage regulator also includes an operational amplifier in the feedback loop. The operational amplifier has at least two operational amplifier input terminals and an operational amplifier output terminal. The operational amplifier output terminal is coupled to the transistor input terminal and the operational amplifier input terminals are coupled to the transistor output terminal. The output of the voltage reference generation circuit is coupled to the output of the high current drive transistor.

SUMMARY

In one aspect the embodiments provide a high current drive bandgap based voltage regulator for providing a reference voltage at a designed output voltage value.

The high current drive bandgap based voltage regulator includes a high current drive output transistor having a transistor input terminal and a transistor output terminal. A feedback network is coupled between the output of the transistor and the input terminal of the transistor. The high current drive bandgap based voltage regulator also includes an operational amplifier in the feedback loop. The operational amplifier has at least two operational amplifier input terminals and an operational amplifier output terminal. The operational amplifier output terminal is coupled to the transistor input terminal and the operational input terminals is coupled to the transistor output terminal. The output of the voltage reference generation circuit is coupled to the output of the high current drive transistor.

The high current drive bandgap based voltage regulator is operable to provide a current of at least 100 μA to the output terminal while maintaining the output voltage at the output terminal at a value substantially equal to the designed output voltage value.

BRIEF DESCRIPTION OF THE DRAWINGS

Several examples of the present invention will now be described in detail with reference to the drawings, in which.

DETAILED DESCRIPTION OF EXAMPLE EMBODIMENTS

Figure 1:
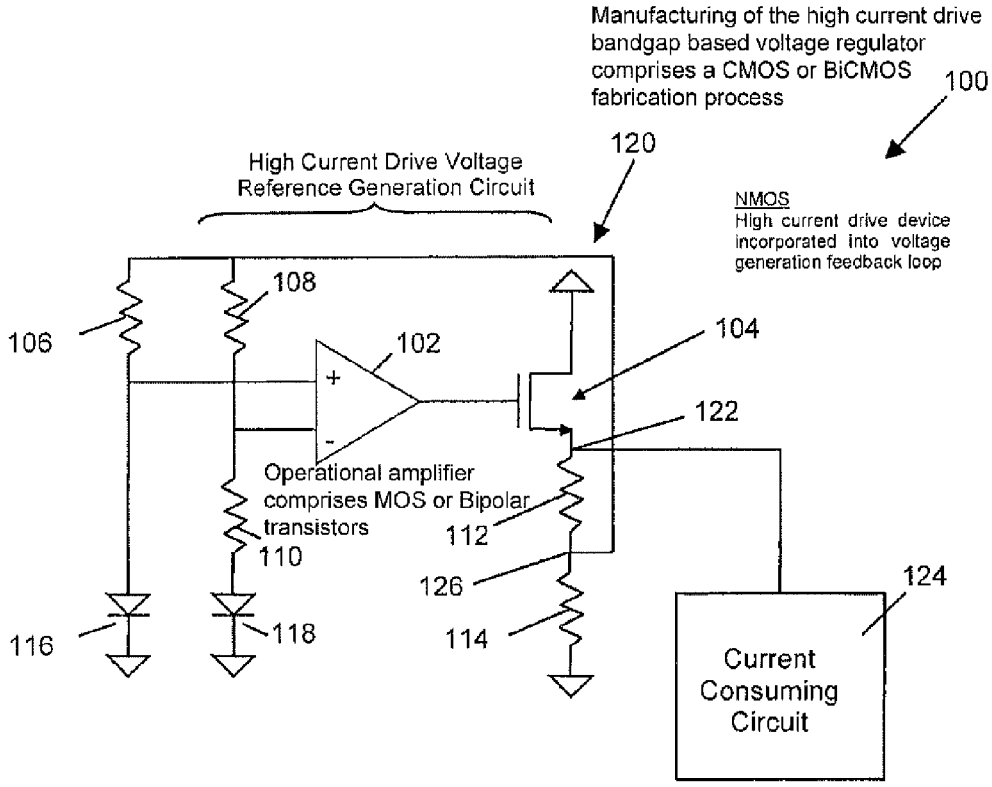
FIG. 1 is a schematic diagram of one example embodiment of a high current drive bandgap based voltage regulator according to the Applicant's teachings.

Reference is first made to FIG. 1, which is a schematic diagram of an example high current drive bandgap based voltage regulator 100. High current drive bandgap based voltage regulator 100 comprises an operational amplifier 102, a high current drive output transistor 104, five resistors 106, 108, 110, 112 and 114, and two diodes 116 and 118. Operational amplifier 102, resistors 106, 108, 110, and 112 as well as diodes 116 and 118 comprise negative feedback network 120. The output of high current drive bandgap based voltage regulator 100 is taken at output terminal 122. High current drive bandgap based voltage regulator output terminal 122 can be coupled to a current consuming circuit 124.

In this embodiment, resistor 112 may be used together with resistor 114 to form a voltage divider. The feedback loop may be connected to voltage divider internal node 126 within the voltage divider. For example, resistor 112 is coupled between high current drive bandgap based voltage regulator output terminal 122 and resistor 114. Resistor 114 is coupled between resistor 112 and a negative polarity terminal, which can be, for example, a ground terminal or a negative voltage supply terminal. In various embodiments, resistors 112 and 114 can be selected to have particular values so that high current drive bandgap based voltage regulator 100 provides a reference voltage at particular value, which may be referred to as the designed output voltage value. Thus, the designed voltage value can depend on various parameters including the values of resistors 112 and 114 and the bandgap voltage of the substrate used to implement the high current drive bandgap based voltage regulator 100. For example, in some embodiments, silicon may be used to implement the substrate and therefore the bandgap voltage of silicon would be a parameter that affects the designed voltage value. In various other embodiments, any appropriate substrate may be used.

The designed output voltage can be expressed as $$V_{out} = V_{bandgap} \times \frac{R_{114} + R_{112}}{R_{114}},$$

where $V_{out}$ is the designed output voltage, $V_{bandgap}$ is the bandgap voltage of the substrate (e.g. for embodiments that utilize silicon as a substrate, the bandgap voltage is the bandgap voltage of silicon), $R_{112}$ is the resistance value of resistor 112, and $R_{114}$ is the resistance value of resistor 114.

In various other embodiments, resistors 112 and 114 are not utilized. In such embodiments, both the output terminal 122 and the feedback network 120 are coupled to the source terminal of transistor 104. In such embodiments, the designed voltage value can be different than when a voltage divider is used. More specifically, $V_{out}=V_{bandgap}$, where $V_{out}$ is the designed output voltage and $V_{bandgap}$ is the bandgap voltage of the substrate (e.g. for embodiments that utilize silicon as a substrate, the bandgap voltage is the bandgap voltage of silicon).

High current drive output transistor 104 is a transistor that is capable of sourcing a large current. In some embodiments transistor 104 is an NMOS (n-channel metal oxide semiconductor) transistor. In certain applications, the use of an NMOS transistor may provide better power supply rejection than would the use of an equivalent PMOS transistor in an analogous design. Power supply rejection is a measure of a device's ability to tolerate changes in the power supply. Given that in many instances, the use of a high current drive bandgap based voltage regulator may be prompted by the need for power supply rejection, an NMOS device may be more appropriate in certain circumstances.

Figure 2:
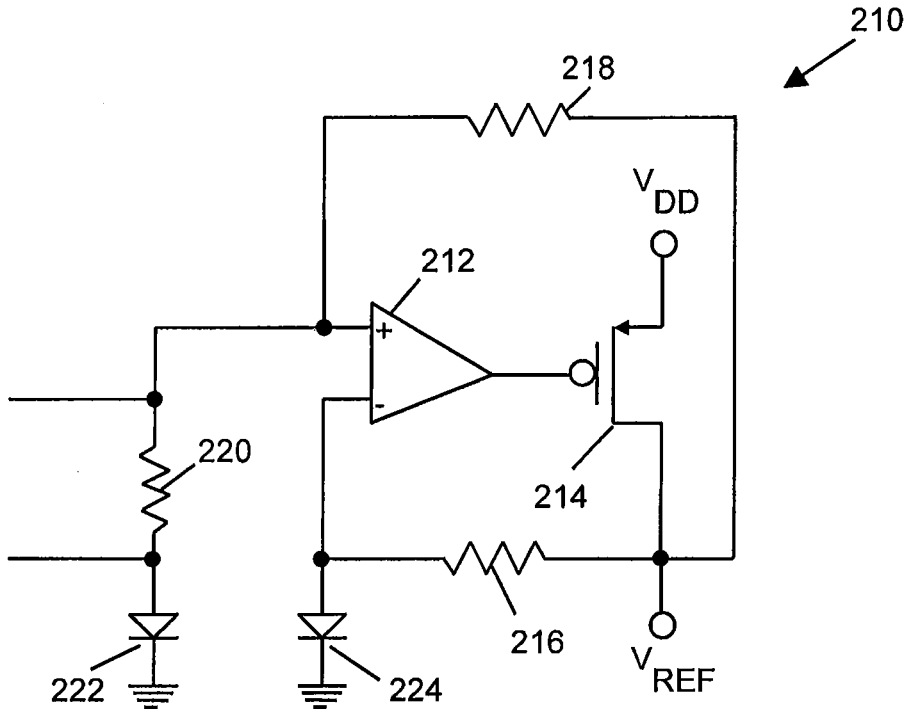
FIG. 2 (PRIOR ART)
FIG. 2 is a schematic diagram of a voltage reference generator circuit regulator.

FIG. 2 illustrates a known voltage reference generator circuit 210. Voltage reference generator circuit 210 comprises an operational amplifier 212, an output transistor 214, three resistors 216, 218, and 220, and two diodes 222 and 224. Traditionally, a voltage reference generator circuit of this type has a design that is not capable of sourcing a large amount of current while maintaining an accurate output voltage. Thus, for applications requiring that a large current be provided, a voltage regulator is typically utilized in conjunction with a reference generator circuit.

Figure 3:
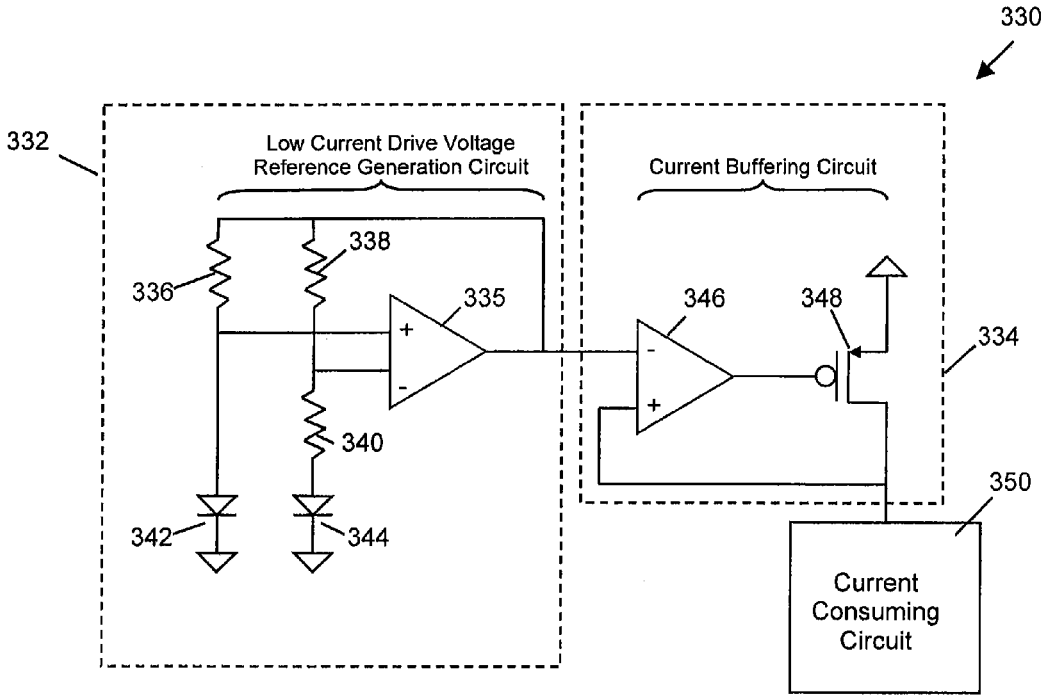
FIG. 3 (PRIOR ART)
FIG. 3 is a schematic diagram of a voltage regulation system.

FIG. 3 illustrates a voltage regulation system 330 that is generally used to provide an accurate current-sourcing voltage to a current consuming circuit 350. Voltage regulation system 330 comprises a low current drive voltage reference generation circuit 332 and a current buffering circuit 334. The current buffering circuit 334 may also be referred to as a voltage regulator. Low current drive voltage reference generation circuit 332 comprises an operational amplifier 335, three resistors 336, 338, and 340, and two diodes 342 and 344. Current buffering circuit 334 comprises an operational amplifier 346 and an output transistor 348.

Known voltage reference generators such as that illustrated in FIG. 2 utilize an output transistor 214 that is relatively small and unable to source a large current. In contrast, high current drive bandgap based voltage regulator 100 utilizes a relatively large transistor that is capable of sourcing a large current. Also, known voltage regulation systems, such as that illustrated in FIG. 3, utilize an extra op amp 346, which complicates the circuit, adds noise and takes up more space on a chip. In contrast, high current drive bandgap based voltage regulator 100 is small and compact and that can provide an accurate voltage while simultaneously providing a large amount of current.

Figure 4:
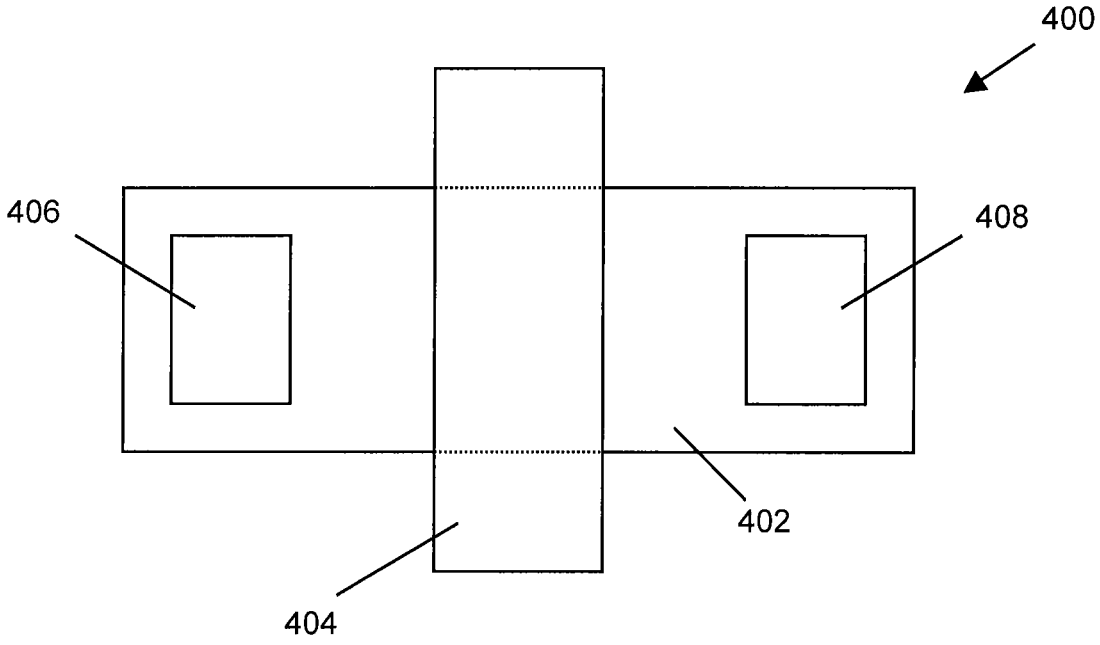
FIG. 4 is a schematic diagram of a transistor that could be used with the high current drive bandgap based voltage regulator of FIG. 1.

Reference is now made to FIG. 4, which is a schematic diagram of a transistor 400, which could be used to implement output transistor 104. Transistor 400 comprises substrate 402, a polysilicon gate 404, a source terminal 406 and a drain terminal 408. As is known in the art, a transistor may be described as having a length L and a width W. However, in some embodiments, output transistor 104 is a multiple finger transistor; whereas, FIG. 4, illustrates a single finger transistor 400 (it should be understood that the number of fingers refers to the number of polysilicon gates 404). This will be explained in greater detail below.

In general, the width W of the transistor 400 is made sufficiently wide such that an appropriate amount of current can be supplied to the current consuming circuit. If the output transistor is not sufficiently wide, then the high current drive bandgap based voltage regulator may not be able to supply sufficient current to the current consuming circuit and the voltage may not be maintained at an appropriate level. The manner in which this is accomplished is discussed in further detail below.

The width of a transistor can be expressed as the total width ($W_t$) or as the width of a single finger ($W_{finger}$) and a variable (e.g. M) to indicate the number of fingers present in the transistor. As used herein W will be used to refer to the total width of a transistor (i.e. $W=W_t$). FIG. 4 illustrates a transistor 400 with a single finger (M=1) and therefore $W=W_{finger}\times M=W_t$. However, as discussed in greater detail below, other embodiments can use a larger number of fingers. The use of a larger number of fingers results in a wider transistor that can transmit a larger current.

Various embodiments of the high current drive bandgap based voltage regulator 100 made in accordance with Applicant's teachings may be used for a wide variety of applications. Examples of possible applications in which embodiments of the regulators discussed herein may be used include, but are not limited to, low-noise amplifiers, digital to analog converters (DACs), analog to digital converters (ADCs), phased lock loops (PLLs), filters, and a variety of Radio Frequency (RF) circuitry such as Mixers, LNA, and RF filters.

In each of these applications, the design of the specific embodiments of the high current drive bandgap based voltage regulator 100 may be altered in order to better suit the needs of the particular application. Specifically, each of these different embodiments of high current drive bandgap based voltage regulator 100 may be optimized in various manners. For example, these optimizations may be accomplished by altering the width W and length L of output transistor 104 as well as the loop gain of feedback network 120 and bandwidth of operational amplifier 102 and output transistor 104. This may effectively trade off several characteristics including, but not limited to, device noise, supply noise rejection, current sourcing ability, and regulation.

Various embodiments of the high current drive bandgap based voltage regulator 100 can output various values of currents. For example, in some embodiments high current drive bandgap based voltage regulator 100 can output a current of at least 100 μA. In some other embodiments, high current drive bandgap based voltage regulator 100 can output a current of at least 1 mA. In some other embodiments, high current drive bandgap based voltage regulator 100 can output a current of at least 10 mA.

In one embodiment, 0.35 μm CMOS technology is utilized to implement output transistor 104 of high current drive bandgap based voltage regulator 100. The output transistor 104 has the following parameter values: L=0.38 μm, $W_{finger}$=5 μm, M=70, and therefore, $W=W_{finger}\times M=(5\ \mu m)\times 70=350\ \mu m$. The use of these values allows the output transistor to drive a current of up to 10 mA. In other implementations, other technology may be used and the parameter values can be adjusted accordingly.

Various embodiments of the high current drive bandgap based voltage regulator 100 may be utilized in a variety of applications. The particular embodiment utilized depends on the particular requirements of the applications in which it is to be used. The above discussion was intended to be an example only. There are a wide variety of applications in which high current drive bandgap based voltage regulator 100 can be used of which only a few have been discussed for illustrative purposes.

Figure 5:
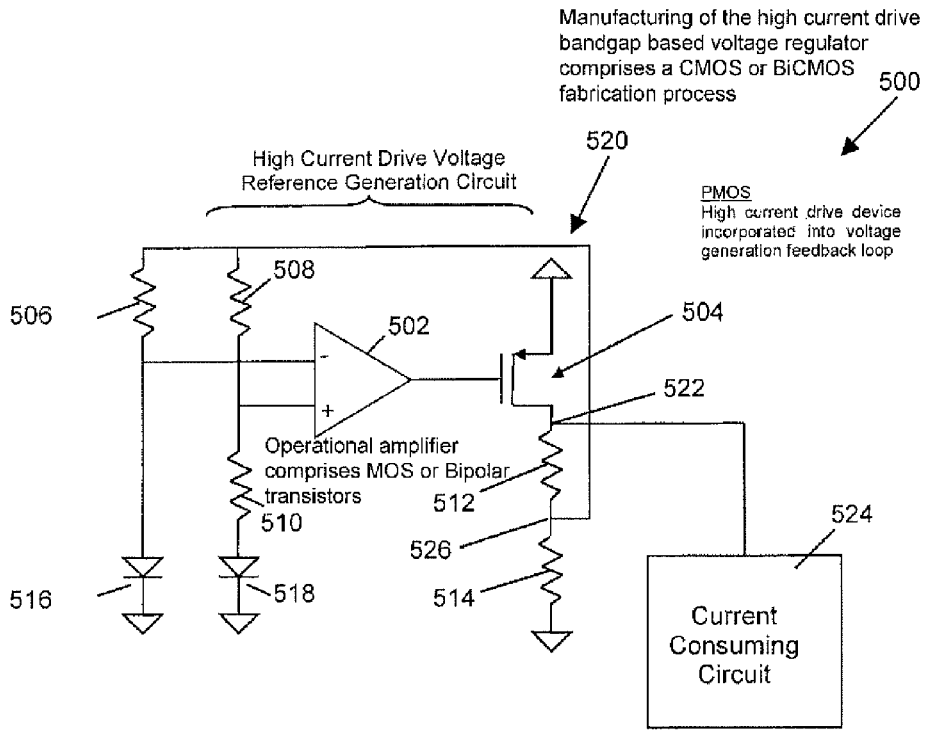
FIG. 5 is a schematic diagram of another example of a high current drive bandgap based voltage regulator according to the Applicant's teachings.

The high current drive bandgap based voltage regulator according to Applicant's teachings may be implemented in a wide variety of embodiments. Reference is now made to FIG. 5, which is a schematic diagram of a high current drive bandgap based voltage regulator 500 according to the Applicant's teachings. High current drive bandgap based voltage regulator 500 comprises an operational amplifier 502, a high current drive output transistor 504, five resistors 506, 508, 510, 512 and 514 and two diodes 516 and 518. Operational amplifier 502, resistors 506, 508, 510, and 512 as well as diodes 516 and 518 comprise feedback network 520. One end of feedback network 520 is coupled to the inputs of operational amplifier 502 and the other end of the feedback network 520 is coupled to voltage divider internal node 526. The output of high current drive bandgap based voltage regulator 500 may be taken at output terminal 522. Output terminal 522 can be coupled to a current consuming circuit 524.

In embodiments based on this design, transistor 504 is a PMOS (p-channel metal oxide semiconductor) transistor. The use of a PMOS transistor can add more gain to the feedback loop than an equivalent NMOS transistor. This can negatively affect the stability of the overall regulator. However, depending on the process used to fabricate the semiconductor circuit, a PMOS transistor may generate less noise then an equivalent NMOS transistor.

In various embodiments, the high current drive bandgap based voltage regulator may be implemented using a biCMOS design. As is known to those skilled in the art, biCMOS designs allow for the combination of advantages of both CMOS and Bipolar transistors in a single circuit. For example, bipolar transistors generally have a greater current driving capability for a given area than do CMOS transistors. On the other hand, CMOS transistors generally have a higher input impedance than do bipolar transistors. The various embodiments illustrated in FIGS. 1, 5, and 6 may utilize bipolar designs.

In some embodiments the output transistor of the high current drive bandgap based voltage regulator is a bipolar transistor. This may provide for several advantages over using a CMOS output transistor. In particular, it may provide for a greater current driving capability for a given area as well as lower noise. In addition, the use of the bipolar transistor may allow for better regulation characteristics.

Figure 6:
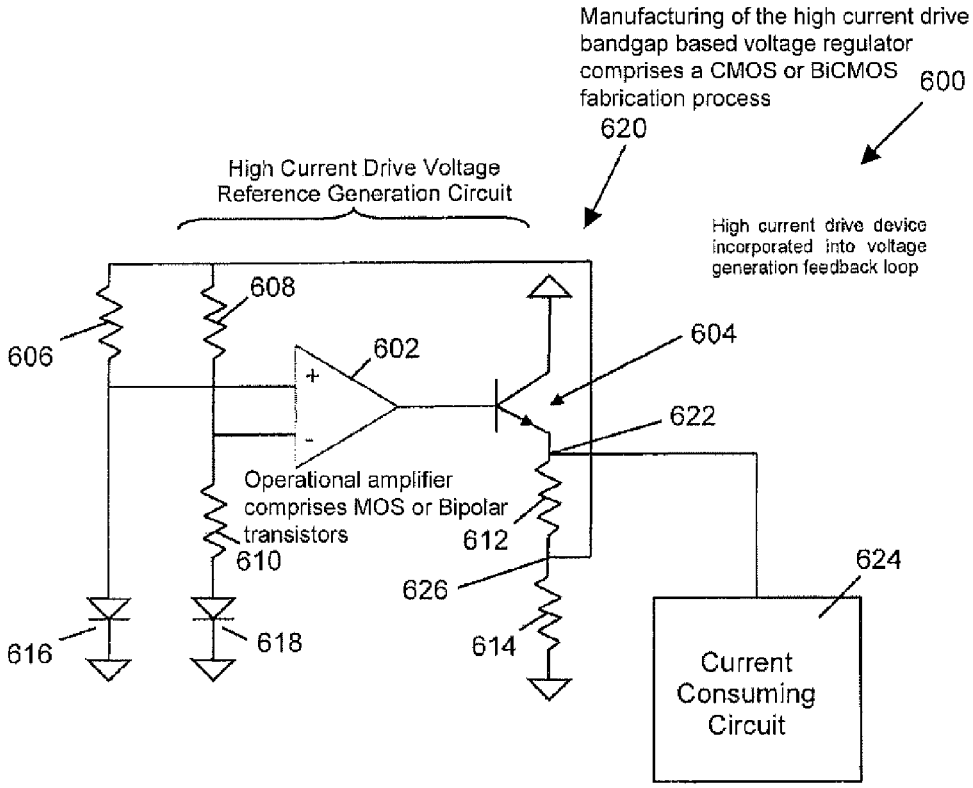
FIG. 6 is a detailed schematic diagram of another example of a high current drive bandgap based voltage regulator according to the Applicant's teachings.

Reference is now made to FIG. 6, which is a schematic diagram of an example embodiment of a high current drive bandgap based voltage regulator 600. High current drive bandgap based voltage regulator 600 comprises an operational amplifier 602, a high current drive output transistor 604, five resistors 606, 608, and 610, 612 and 614 and two diodes 616 and 618. High current drive bandgap based voltage regulator 600 is an example of a high current drive bandgap based voltage regulator having an output transistor 604 that is a bipolar transistor. The embodiment illustrated in FIG. 6 utilizes a NPN bipolar junction transistor (BJT) as the output transistor 604. However, other embodiments may utilize a PNP BJT as the output transistor 604.

Operational amplifier 602, resistors 606, 608, 610, and 612 as well as diodes 616 and 618 comprise feedback network 620. One end of feedback network 620 is coupled to the inputs of operational amplifier 602 and the other end of the feedback network 620 is coupled to voltage divider internal node 626. The output of high current drive bandgap based voltage regulator 600 is taken at output terminal 622. Output terminal 622 can be coupled to a current consuming circuit 624.

In various embodiments, bipolar transistors can be used to implement the operational amplifier. This would allow for a lower noise operational amplifier. The decision to use bipolar transistors in the operational amplifier can be made regardless of the specific implementation used for the output transistor. In particular, the operational amplifiers of FIGS. 1, 5, and 6 can utilize bipolar transistors in the implementation of the amplifiers.

The present invention has been described here by way of example only. Various modification and variations may be made to these example embodiments without departing from the spirit and scope of the invention, which is defined by the appended claims.

I claim:

1. A high current drive bandgap based voltage regulator for providing an output voltage at a designed output voltage value, the high current drive bandgap based voltage regulator implemented in a substrate and comprising:

a high current drive output transistor having a transistor input terminal and a transistor output terminal;

a feedback network coupled between the transistor output terminal and the transistor input terminal;

an operational amplifier in the feedback network, the operational amplifier having at least two operational amplifier input terminals and an operational amplifier output terminal, the operational amplifier output terminal being connected only by a non-active circuit element to the transistor input terminal, and the operational amplifier input terminals being coupled to the transistor output terminal using the feedback network and to a negative polarity terminal using first and second diodes; and a high current drive bandgap based voltage regulator output terminal connected only by a non-active circuit element to the transistor output terminal, the output voltage provided at the high current drive bandgap based voltage regulator output terminal;

wherein the high current drive bandgap based voltage regulator is operable to provide a current of at least 100 μA to the high current drive bandgap based voltage regulator output terminal while maintaining the output voltage at the high current drive bandgap based voltage regulator output terminal at a value substantially equal to the designed output voltage value and depending on a bandgap voltage of the substrate.

2. The high current drive bandgap based voltage regulator as claimed in claim 1, wherein the high current drive output transistor is an NMOS transistor.

3. The high current drive bandgap based voltage regulator as claimed in claim 1, wherein the high current drive output transistor is a PMOS transistor.

4. The high current drive bandgap based voltage regulator as claimed in claim 1, wherein the high current drive output transistor is a PNP bipolar transistor.

5. The high current drive bandgap based voltage regulator as claimed in claim 1, wherein the high current drive output transistor is an NPN bipolar transistor.

6. The high current drive bandgap based voltage regulator as claimed in claim 1, wherein the high current drive bandgap based voltage regulator is operable to provide a source current of at least 1 mA while maintaining the designed output voltage value.

7. The high current drive bandgap based voltage regulator as claimed in claim 1, wherein the high current drive bandgap based voltage regulator is operable to provide a source current of at least 10 mA while maintaining the designed output voltage value.

8. The high current drive bandgap based voltage regulator as claimed in claim 1, wherein one of the at least two operational amplifier input terminals is coupled to the negative polarity terminal through the first diode and one other of the at least two operational amplifier input terminals is coupled to the negative polarity terminal through the second diode and a third resistor.

9. The high current drive bandgap based voltage regulator as claimed in claim 1, further comprising:

a voltage divider connected between the high current drive bandgap based voltage regulator output terminal and the negative polarity terminal, the voltage divider having a voltage divider internal node;

wherein the feedback network is coupled to the voltage divider internal node.

10. The high current drive bandgap based voltage regulator as claimed in claim 9, wherein the voltage divider comprises a first resistor and a second resistor; and wherein the first and second resistors are selected to provide the designed output voltage value.

11. The high current drive bandgap based voltage regulator as claimed in claim 10, wherein the voltage divider internal node is coupled to a first operational amplifier input terminal through a fourth resistor and the voltage divider internal node is coupled to a second operational amplifier input terminal through a fifth resistor.

12. The high current drive bandgap based voltage regulator as claimed in claim 11, wherein the first operational amplifier input terminal is coupled to the negative polarity terminal through the first diode and the second operational amplifier input terminal is coupled to the negative polarity terminal through the second diode and a third resistor.

13. A high current drive bandgap based voltage regulator for providing an output voltage at a designed output voltage value, the high current drive bandgap based voltage regulator implemented in a substrate and comprising:

a high current drive output transistor having a transistor input terminal and a transistor output terminal;

a feedback network coupled between the transistor output terminal and the transistor input terminal;

an operational amplifier in the feedback network, the operational amplifier having at least two operational amplifier input terminals and an operational amplifier output terminal, the operational amplifier output terminal being connected to the transistor input terminal, and the operational amplifier input terminals being coupled to the transistor output terminal using the feedback network and to a negative polarity terminal using first and second diodes; and a high current drive bandgap based voltage regulator output terminal connected to the transistor output terminal, the output voltage provided at the high current drive bandgap based voltage regulator output terminal;

wherein the high current drive bandgap based voltage regulator is operable to provide a current of at least 100 μA to the high current drive bandgap based voltage regulator output terminal while maintaining the output voltage at the high current drive bandgap based voltage regulator output terminal at a value substantially equal to the designed output voltage value and depending on a bandgap voltage of the substrate.

14. The high current drive bandgap based voltage regulator as claimed in claim 13, further comprising:

a voltage divider connected between the high current drive bandgap based voltage regulator output terminal and the negative polarity terminal, the voltage divider having a voltage divider internal node, wherein the feedback network is coupled to the voltage divider internal node.

15. The high current drive bandgap based voltage regulator as claimed in claim 13, wherein one of the at least two operational amplifier input terminals is coupled to the negative polarity terminal through the first diode and one other of the at least two operational amplifier input terminals is coupled to the negative polarity terminal through the second diode and a third resistor.

16. The high current drive bandgap based voltage regulator as claimed in claim 15, wherein the voltage divider internal node is coupled to a first operational amplifier input terminal through a fourth resistor and the voltage divider internal node is coupled to a second operational amplifier input terminal through a fifth resistor.

* * * * *